US006796631B2

(12) United States Patent
Kojima

(10) Patent No.: US 6,796,631 B2
(45) Date of Patent: Sep. 28, 2004

(54) METHOD OF DETERMINING DRIVING VOLTAGE FOR INK JET PRINT HEAD

(75) Inventor: Masatomo Kojima, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/127,658

(22) Filed: Apr. 23, 2002

(65) Prior Publication Data

US 2002/0167558 A1 Nov. 14, 2002

(30) Foreign Application Priority Data

Apr. 23, 2001 (JP) ..... 2001-123876

(51) Int. Cl.[7] ..... B41J 29/393
(52) U.S. Cl. ..... 347/19
(58) Field of Search ..... 347/4, 9, 14, 17, 347/19

(56) References Cited

U.S. PATENT DOCUMENTS 5,402,159 A 3/1995 Takahashi et al. ..... 347/9
5,757,392 A * 5/1998 Zhang ..... 347/14
6,036,297 A * 3/2000 Hayasaki ..... 347/13
2002/0054181 A1 * 5/2002 Murakami ..... 347/19

FOREIGN PATENT DOCUMENTS

JP A 3-274159 12/1991 ..... B41J/2/045

* cited by examiner

*Primary Examiner*—Stephen D. Meier
*Assistant Examiner*—Alfred E. Dudding
(74) *Attorney, Agent, or Firm*—Oliff & Berridge, PLC

(57) ABSTRACT

First, the average of the diameters of the nozzles is determined. Next, the average of the capacitances of the piezoelectric elements is determined. Then, an optimum driving voltage is calculated based on a predetermined formula that represents the relationship between the nozzle-diameter average, the capacitance average, and the driving voltage to be applied from the driving device to the piezoelectric actuator. When one print head is made from several head units, several head units, for which the driving voltages of the same values are estimated as optimum, are selected and assembled together into the single print head.

17 Claims, 5 Drawing Sheets

METHOD OF DETERMINING DRIVING VOLTAGE FOR INK JET PRINT HEAD

BACKGROUND OF THE INVENTION

1. Field of the Invention

The present invention relates to a method of determining the value of a driving voltage applied to a piezoelectric ink jet print head and adjusting the ink ejection condition of the print head.

2. Description of Related Art

An ink jet print head is provided in an ink jet printer. There has been proposed that a piezoelectric type ink-jet print head unit is employed as the ink jet print head. In this type of print head unit, a piezoelectric element is provided to each pressure chamber. By applying an electric voltage to the piezoelectric element, the volume of the corresponding pressure chamber decreases, thereby causing ink to be ejected through a nozzle from the pressure chamber.

In order to manufacture this type of print head unit, a plurality of piezoelectric ceramic sheets are prepared. Internal electrode layers are screen-printed on the piezoelectric ceramic sheets. The piezoelectric ceramic sheets are stacked one on another, pressed against one another, and then baked into a single actuator. In the thus produced actuator, a plurality of piezoelectric elements are defined by a plurality of internal electrode sections, which are defined by the internal electrode layers.

A cavity plate is formed with a plurality of pressure chambers. The actuator is then bonded to the cavity plate so that the piezoelectric elements are located in one to one correspondence with the pressure chambers.

A nozzle plate is made from polyimide or the like, and is formed with a plurality of nozzles. The nozzle plate is bonded to the cavity plate, thereby finally obtaining the ink jet print head unit.

SUMMARY OF THE INVENTION

There are, however, variations in the diameters of nozzles formed in the nozzle plate. There are variations also in the characteristics of the piezoelectric elements. Due to these variations, there are variations in the ink ejection performances in the individual ink jet print head units.

Considering this, the driving voltages to be applied to the head units should be determined individually so that each head unit can eject ink with an optimum ejection speed.

In order to determine the driving voltage, it is conceivable to introduce ink in each head unit. How the head unit ejects ink is monitored while changing the driving voltage applied to the head unit. Printed samples are produced based on the ejected ink, and an observer or worker observes the printed samples. Based on the monitored results and on the observation results of the printed samples, the optimum driving voltage is determined for each head unit.

The above-described conceivable driving-voltage determining method, however, suffers from the problem that the inside of the head unit is stained or smeared with ink when ink is introduced into the print head.

Additionally, the above-described driving-voltage determining method depends on the observer's ability, and therefore is unreliable.

When a single print head is configured from several head units for several colors of ink, there arises the case where the driving voltages for the respective head units are determined as different from one another. In such a case, the power source provided in the printer has to be configured to supply several different voltages simultaneously. The costs of manufacturing the power source increases.

In view of the above-described drawbacks, it is an objective of the present invention to provide an improved method of determining the value of the driving voltage for an ink jet print head unit to adjust the ink ejection condition of the head unit, which does not necessitate introducing ink into the print head, which can determine an optimum driving voltage for a head unit with a simple configuration, and which can set the same, single driving voltage to all the head units provided in a single print head.

In order to attain the above and other objects, the present invention provides a method of determining the value of a driving voltage to be applied to an ink jet print head unit, the ink jet print head unit including a cavity plate and a plurality of piezoelectric elements, the cavity plate being formed with a plurality of pressure chambers and a plurality of nozzles, each pressure chamber being filled with ink and being in fluid communication with a corresponding nozzle, the plurality of piezoelectric elements being provided in one to one correspondence with the plurality of pressure chambers, each piezoelectric element being driven by a driving voltage so as to change the pressure inside the corresponding pressure chamber, thereby allowing ink to be ejected through the corresponding nozzle from the corresponding pressure chamber, the method comprising the steps of: determining at least one of a nozzle-diameter average and a capacitance average, the nozzle-diameter average indicating average of diameters of the plurality of nozzles, the capacitance average indicating average of capacitances of the plurality of piezoelectric elements; and determining a driving voltage to be applied to the piezoelectric elements of the ink jet print head unit by using the determined at least one of the nozzle-diameter average and the capacitance average, and based on a predetermined formula, which is indicative of a relationship of the driving voltage with respect to the at least one of the nozzle-diameter average and the capacitance average.

According to the present invention, therefore, it is possible to easily determine a driving voltage, which should be applied to the ink jet head unit, without actually introducing ink to the ink jet head unit to cause the ink jet head unit to eject ink.

The average-determining step may preferably include at least one of the steps of: determining the nozzle-diameter average, by measuring the diameters of all the nozzles in the ink jet print head unit, and by calculating the nozzle-diameter average based on the measured diameters; and determining the capacitance average, by measuring capacitances of all the piezoelectric elements in the ink jet print head unit, and by calculating the capacitance average based on the measured capacitances. In this case, the driving-voltage determining step calculates the predetermined formula by using the determined at least one of the nozzle-diameter average and the capacitance average, thereby determining the driving voltage.

For example, the nozzle-diameter average can be determined as an arithmetic mean, that is, a quotient obtained by dividing the sum total of the diameters measured for all the nozzles by the number of the nozzles. Similarly, the capacitance average can be determined as an arithmetic mean, that is, a quotient obtained by dividing the sum total of the capacitances measured for all the piezoelectric elements by the number of the piezoelectric elements.

The method may further comprise the step of preparing a plurality of ink jet head units. In this case, the average determining step determines at least one of the nozzle-diameter average and the capacitance average for each ink jet head unit, and the driving-voltage determining step determines the driving voltage to be applied to the piezoelectric elements in each ink jet head unit based on the at least one of the nozzle-diameter average and the capacitance average that is determined for the each ink jet head unit. The method may further comprise the steps of: selecting, among the plurality of ink jet head units, several ink jet head units, for which the driving-voltage determining step has determined the driving voltage of substantially the same values; and assembling together the selected several ink jet head units into a single ink jet print head.

In this way, after preparing a plurality of ink jet head units, an optimum driving voltage is determined for each ink jet head unit in the manner described above. Then, several ink jet head units, for which substantially the same driving voltages have been determined, are selected and assembled together into a single print head. Accordingly, it is possible to apply substantially the same driving voltages to all the head units in the single print head. When manufacturing a printer provided with this print head, it is possible to mount the printer with a power source that supplies a single voltage, only. The costs required for producing the power source can be reduced.

For example, the predetermined formula is indicative of a relationship of the driving voltage with respect to both of the nozzle-diameter average and the capacitance average. In this case, the average-determining step includes both of the steps of determining the nozzle-diameter average; and determining the capacitance average. The driving-voltage determining step determines the driving voltage by using the determined nozzle-diameter average and the determined capacitance average. That is, the driving-voltage determining step calculates the predetermined formula by using the determined nozzle-diameter average and the determined capacitance average.

In this case, the predetermined formula preferably represents a relationship among the driving voltage, the nozzle-diameter average, the capacitance average, a slope of a linear or straight line approximately representing the relationship between the nozzle-diameter average and an ejection-speed average, which is indicative of an average of ejection speeds, at which the plurality of nozzles eject ink, and a slope of another linear or straight line approximately representing the relationship between the capacitance average and the ejection-speed average. In this case, the driving-voltage determining step determines the driving voltage by calculating the predetermined formula based on the calculated nozzle-diameter average and the calculated capacitance average.

It is noted that the slope of the linear line approximately representing the relationship between the nozzle-diameter average and the ejection-speed average is determined previously. Similarly, the slope of the linear line approximately representing the relationship between the capacitance average and the ejection-speed average is also determined previously. The formula indicative of the driving voltage is determined by using these slopes and by using variables representing the nozzle-diameter average and the capacitance average. After calculating the nozzle-diameter average and the capacitance average for the subject ink jet print head, it is possible to determine the driving voltage by substituting those calculated values for the variables in the formula.

The predetermined formula may preferably be represented by $E=E_0-\{\alpha(C-C_0)+\beta(D-D_0)\}/\epsilon$, wherein $\alpha$ is the slope of the linear line approximately representing the relationship between the capacitance average and the ejection-speed average, $\beta$ is the slope of the linear line approximately representing the relationship between the nozzle-diameter average and the ejection-speed average, D is a nozzle-diameter average variable, C is a capacitance-average variable, $D_0$ is a predetermined nozzle diameter design value, $C_0$ is a predetermined capacitance design value, $E_0$ is a predetermined driving voltage design value, $\epsilon$ is a sensitivity of the ejection speed relative to the driving voltage, and E is the driving voltage. The driving-voltage determining step determines the driving voltage E by substituting the calculated nozzle-diameter average and the calculated capacitance average for the nozzle-diameter average variable D and the capacitance-average variable C, respectively, in the formula.

It is noted that if the ink jet print head unit is produced accurately based on the design values $C_0$ and $D_0$, that is, if each piezoelectric element has a capacitance $C_0$ and each nozzle has a nozzle diameter $D_0$, when the piezoelectric element is driven by the driving voltage design value $E_0$, the piezoelectric element will perform ink-ejection operation through the corresponding nozzle at a desired, ejection-speed design value $V_0$.

On the other hand, if the ink-jet print head unit is produced with their piezoelectric elements having capacitances average C and with their nozzles having nozzle-diameter average D, when the ink-jet print head unit is driven by the driving voltage E that satisfies the above-described formula, the ink-jet print head unit will perform ink-ejection operation at its ejection-speed average being substantially equal to the desired, ejection-speed design value $V_0$. Accordingly, it is possible to easily determine the driving voltage E optimum for the head unit, by merely substituting the calculated nozzle-diameter average for the variable D and by substituting the calculated capacitance average for the variable C.

It is noted that the capacitance average determining step may set the capacitance design value $C_0$ as the capacitance average C. In this case, the driving voltage determining step determines the driving voltage based on the predetermined formula and based on the nozzle-diameter average, the predetermined formula being modified as $E=E_0-\{\beta(D-D_0)\}/\epsilon$. More specifically, if the ink-jet print head unit is produced with their piezoelectric elements having capacitance average substantially equal to the capacitance design value $C_0$ and with their nozzles having nozzle-diameter average D, when the head unit is driven by the driving voltage E that satisfies the above-described formula, the head unit will perform ink-ejection operation at an ejection-speed average substantially equal to the desired, ejection-speed design value $V_0$. Accordingly, it is possible to easily determine the driving voltage E optimum for the head unit, by merely substituting the calculated nozzle-diameter average for the variable D.

The nozzle-diameter average calculating step may set a nozzle-diameter design value $D_0$ as the nozzle-diameter average D. In this case, the driving voltage determining step determines the driving voltage based on the predetermined formula and based on the capacitance average, the predetermined formula being modified as $E=E_0-\{\alpha(C-C_0)\}/\epsilon$. More specifically, if the ink-jet print head unit is produced with their piezoelectric elements having capacitance average C and with their nozzles having nozzle-diameter average substantially equal to the design value $D_0$, when the head unit is driven by the driving voltage E that satisfies the above-described formula, the head unit will perform ink-ejection operation at an ejection-speed average substantially equal to the desired, ejection-speed design value $V_0$. Accordingly, it is possible to easily determine the driving voltage E optimum for the subject head unit, by merely substituting the calculated capacitance average for the variable C.

According to another aspect, the present invention provides a method of adjusting an ink jet print head unit, the ink jet print head unit being connected to a driving device and including a cavity plate and a plurality of piezoelectric elements, the cavity plate being formed with a plurality of pressure chambers and a plurality of nozzles, each pressure chamber being filled with ink and being in fluid communication with a corresponding nozzle, the plurality of piezoelectric elements being provided in one to one correspondence with the plurality of pressure chambers, each piezoelectric element being driven by a driving voltage applied from the driving device so as to change the pressure inside the corresponding pressure chamber, thereby allowing ink to be ejected through the corresponding nozzle from the corresponding pressure chamber, the method comprising the steps of: calculating a nozzle-diameter average indicating an average of diameters of the plurality of nozzles; calculating a capacitance average indicating an average of capacitances of the plurality of piezoelectric elements; and determining a driving voltage to be applied to the piezoelectric elements based on a predetermined formula that indicates a relationship between the driving voltage and the nozzle-diameter average and the capacitance average.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
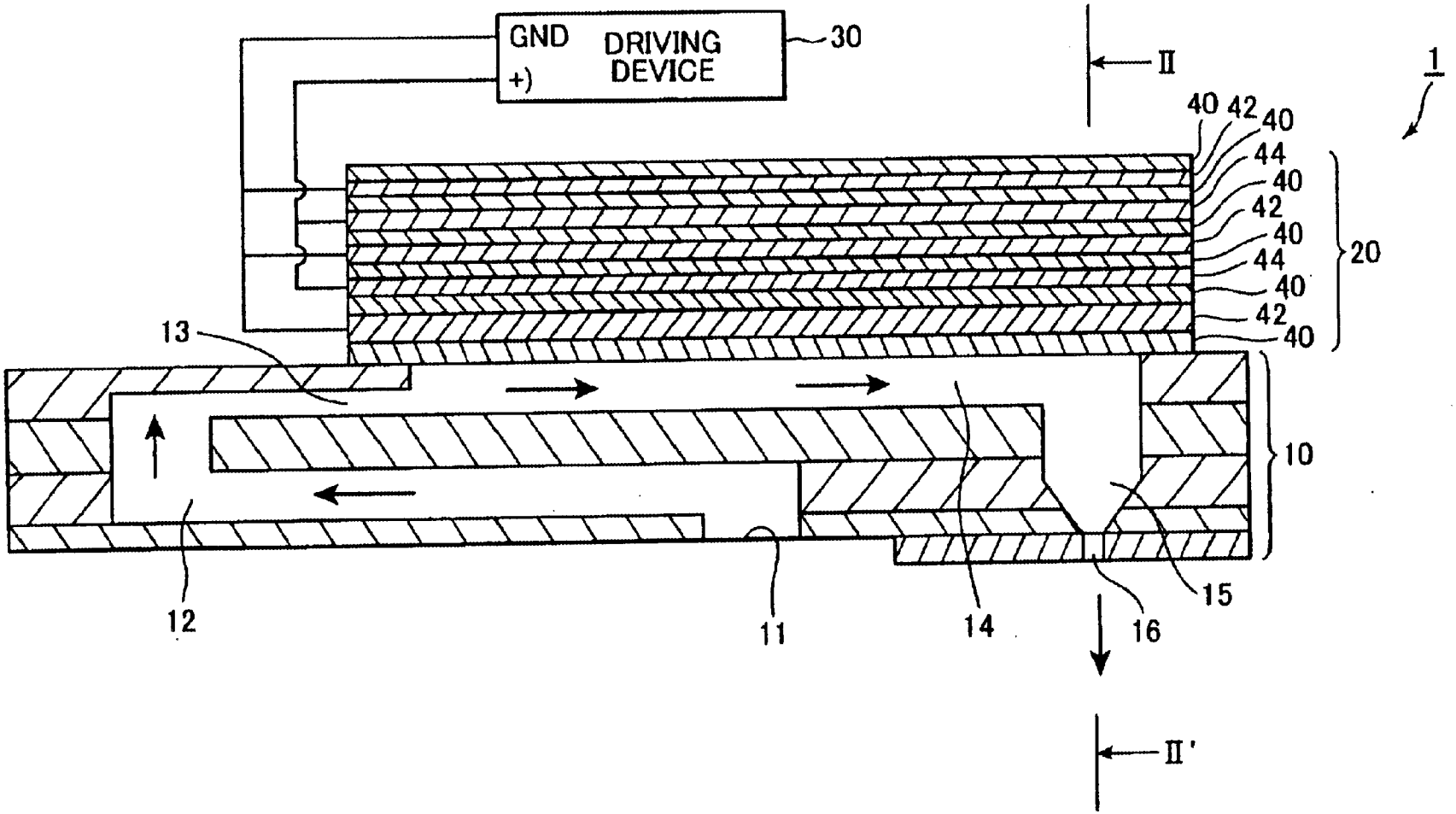
FIG. 1 is a sectional view showing the structure of a piezoelectric ink-jet print head unit according to a preferred embodiment of the present invention.

A method of determining the value of the driving voltage for an ink jet print head according to a preferred embodiment of the present invention will be described while referring to the accompanying drawings wherein like parts and components are designated by the same reference numerals to avoid duplicating description.

Figure 2:
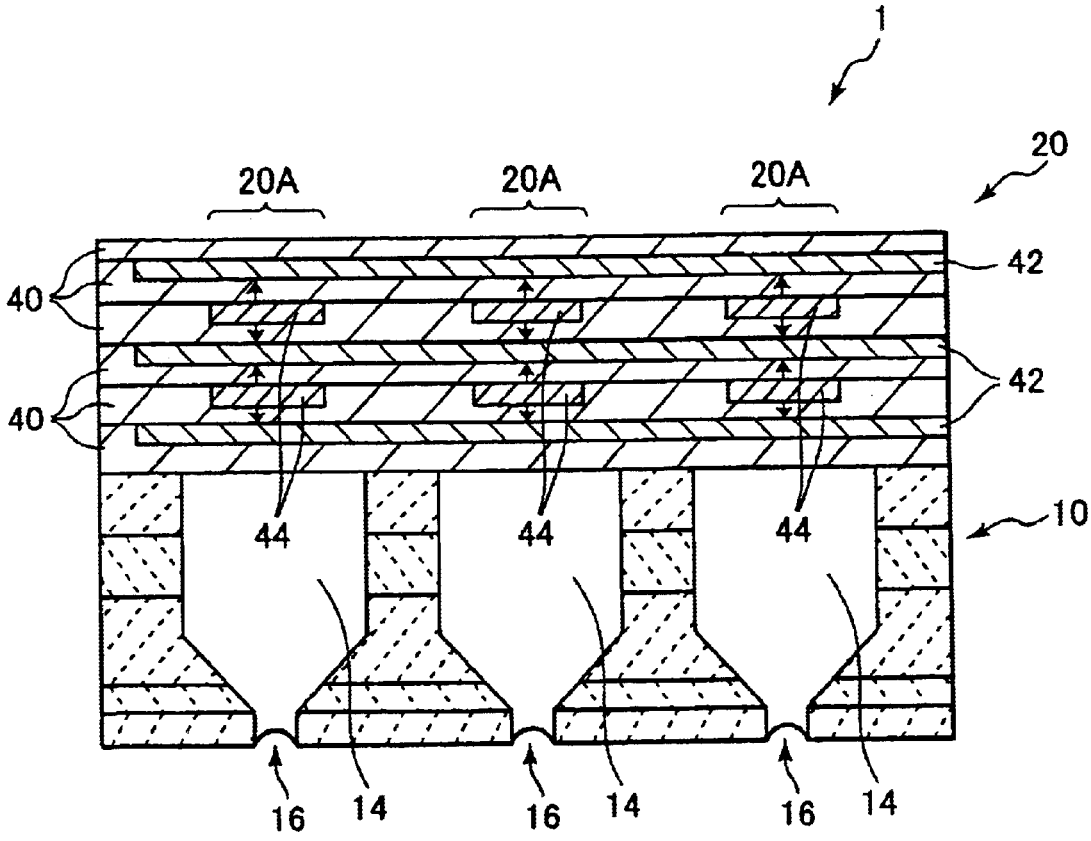
FIG. 2 is a cross-sectional view of the ink-jet print head unit of the embodiment taken along a line II–II' in FIG. 1.

FIG. 1 is a block diagram showing an ink jet print head unit 1, which is connected to a driving device 30. FIG. 2 shows a cross-section of the ink jet print head unit 1 taken along a line II–II' in FIG. 1. As shown in FIGS. 1 and 2, the ink jet print head unit 1 is constructed from a cavity plate 10 and a piezoelectric actuator 20, which are bonded with each other.

The cavity plate 10 is made from a stack of a plurality of metal plates, which are bonded together by an adhesive agent. Each metal plate has a thickness of 50 $\mu$m to 150 $\mu$m thickness and is made of 42% nickel alloy steel (42 alloy), for example. It is noted, however, that the cavity plate 10 may be formed from a stack of a plurality of resin plates, for example.

As shown in FIGS. 1 and 2, the cavity plate 10 is formed with an ink supply inlet 11, a manifold 12; a plurality of restriction grooves 13; a plurality of pressure chambers 14; a plurality of descending holes 15, and a plurality of nozzles 16. The ink supply inlet 11 is connected to an ink supply source (not show). The manifold 12 is in fluid communication with the ink supply inlet 11. Each pressure chamber 14 is in fluid communication with the manifold 12 via a corresponding restriction groove 13. Each pressure chamber 14 is in fluid communication with a corresponding nozzle 16 via a corresponding descending hole 15. In the drawing of FIG. 2, for the clarity and simplicity, the cavity plate 10 is formed with three pressure chambers 14. However, the cavity plate 10 is formed with a greater number of pressure chambers 14.

As shown in FIG. 2, the piezoelectric actuator 20 has a structure, in which a plurality of piezoelectric sheets 40 and a plurality of driving electrodes 42, 44 are stacked alternately one on another. In this example, the piezoelectric actuator 20 has a structure the same as that of a piezoelectric actuator disclosed in the U.S. Pat. No. 5,402,159.

More specifically, the piezoelectric actuator 20 of the present embodiment is a lamination made of: piezoelectric ceramic layers 40; common negative electrodes 42; and individual positive electrodes 44. The piezoelectric ceramic layers 40 have piezoelectric/electrostrictive characteristics, and are previously polarized in directions, as indicated by arrows, at locations between the individual positive electrodes 44 and the common negative electrodes 42. Each common negative electrode 42 is provided over the plurality of pressure chambers 14. Each individual positive electrode 44 is located at a position corresponding to a corresponding one pressure chamber 14. As shown in FIG. 1, the common negative electrodes 42 are connected to a ground terminal of the driving device 30. The individual positive electrodes 44 are connected to a positive-voltage terminal of the driving device 30. The piezoelectric sheet stack 20 has a plurality of piezoelectric element regions (actuation regions) 20A, in one to one correspondence with the plurality of pressure chambers 14, at regions where the individual positive electrodes 44 are located. Each actuation region 20A is deformed when the corresponding individual positive electrodes 44 are supplied with a driving pulse of a driving voltage from the driving device 30.

The driving device 30 has a memory (not shown) prestored with data indicative of the value E of the driving voltage. The driving device 30 also has a control portion (not shown) for selectively supplying driving pulses with the driving voltage E to the piezoelectric actuator 20 in synchronization with clock signals.

With the above-described structure, when the driving device 30 supplies a driving pulse with the voltage E to the individual positive driving electrodes 44 for one selected pressure chamber 14, the part of the piezoelectric sheet stack (piezoelectric element 20A) corresponding to the pressure chamber 14 is deformed in the stacking direction due to the piezoelectric effect. This deformation pressurizes the pressure chamber 14 to decrease the volume of the pressure chamber 14. As a result, an ink droplet is ejected through the nozzle 16 from the pressure chamber 14, thereby performing printing operation. It is noted that when the voltage value E of the driving pulse changes, the ink ejection speed V also changes.

When desiring to produce one ink jet print head for performing monochromatic printing, the ink jet print head is constructed from the single ink jet print head unit 1. When desiring to produce one ink jet print head for performing multicolor printing, the ink jet print head is produced by assembling together several ink jet print head units 1.

It is noted that even when a plurality of ink jet print head units are produced so that they will have the same dimensions and the same size, the actually-produced ink jet print head units 1 generally have variations in the diameter of the nozzles 16 and in the capacitance of the piezoelectric elements 20A. The diameter of the nozzles 16 varies dependently on the machining accuracy. The capacitance of the piezoelectric elements 20A varies dependently on the machining accuracy and on the variations in the characteristics of the material of the piezoelectric ceramic sheets 40. When the individual ink jet print head units 1 are different in their nozzle diameters and/or in their piezoelectric-element capacitances, the ink jet print head units have different ink-ejection characteristics. In other words, even when the print head units 1 are supplied with driving pulses with the same voltages, the ink jet print head units 1 will eject ink with different ejection speeds.

(Experiment)

The present inventor performed an experiment in order to examine how the ink ejection speed is affected by the nozzle diameter and by the piezoelectric-element capacitance.

The present inventor produced a plurality of ink-jet print head unit samples 1 so that they will have the same configuration as shown in FIGS. 1 and 2 and so that they will eject ink with a predetermined ejection-speed (ejection-speed design value) $V_0$ upon application with a predetermined driving voltage (driving-voltage design value) $E_0$. It is noted that if a piezoelectric element 20A has capacitance (capacitance design value) $C_0$ and a corresponding nozzle 16 has a nozzle-diameter (nozzle-diameter design value) $D_0$, when the piezoelectric element 20A is applied with the driving voltage $E_0$, the piezoelectric element 20A performs ink ejection with the ejection speed $V_0$ via the corresponding nozzle 16. Accordingly, the present inventor produced the plural head unit samples 1 so that they will have nozzles 16 with the nozzle diameter design value $D_0$ and so that they will have piezoelectric element 20A with the capacitance design value $C_0$. However, when the head unit samples were actually produced, they had variations in their nozzle-diameters and in their piezoelectric-element capacitances, and therefore had variations in their ejection speeds.

(First Experiment)

The present inventor performed a first experiment in order to examine how the ink ejection speed is affected by the nozzle diameter.

The present inventor first examined the relationship between the nozzle-diameter and the ejection-speed for one head unit sample 1 in a manner described below.

The present inventor measured the diameters of all the nozzles 16 in the subject head unit sample 1, and calculated the average D of the nozzle diameters.

It is noted that in order to measure the diameter of each nozzle 16, the image of the nozzle 16 is magnified by a microscope. The magnified image is picked up by an image pick-up device, and data of the magnified image is subjected to an image processing such as an edge enhancement process. The diameter of the nozzle 16 is measured based on the processed image. Other various methods of measuring the nozzle diameter can be employed.

It is also noted that the nozzle-diameter average D is calculated as a quotient obtained by dividing the sum total of the diameters of all the nozzles 16 by the number of the nozzles 16.

The present inventor then actuated the subject head unit sample 1 by supplying each piezoelectric element 20A with the driving-voltage of the design value $E_0$ to cause the piezoelectric element 20A to eject ink through the corresponding nozzle 16. The present inventor measured the ink ejection speed, at which the nozzle 16 ejected ink. In this way, the present inventor measured the ink ejection speed at all the nozzles 16. The present inventor then calculated the average V of the ink ejection speeds.

It is noted that in order to measure the ink ejection speed at each nozzle 16, the present inventor employed a static-image pick up device in a manner described below. Each piezoelectric element 20A is applied with the driving pulse with the driving voltage $E_0$ at a predetermined uniform interval so that the corresponding nozzle 16 ejected ink at the same interval. By flashing a strobe light onto the nozzle 16 simultaneously with one of the ejection timings, the static-image pick up device picked up the static image exactly when the nozzle 16 ejected an ink droplet. By again flashing the strobe light by a certain period of time elapsing thereafter, the static-image pick up device picked up the static image of the ink droplet again. The ejection speed is determined based on the difference between the locations of the ink droplet at the two timings.

It is also noted that the ejection-speed average V is calculated as a quotient obtained by dividing the sum total of the ejection-speeds measured at all the nozzles 16 by the number of the nozzles 16.

In this way, the present inventor determined the nozzle-diameter average D and the ejection-speed average V for the head unit sample 1. Then, in order to know the relationship between the nozzle-diameter average D and the ejection-speed average V, the present inventor plotted a measured-result point (D, V), indicative of the nozzle-diameter average D and the ejection-speed average V, in the graph of FIG. 3(A), in which the horizontal axis denotes the nozzle-diameter average D and the vertical axis denotes the ejection-speed average V.

Figure 3A:
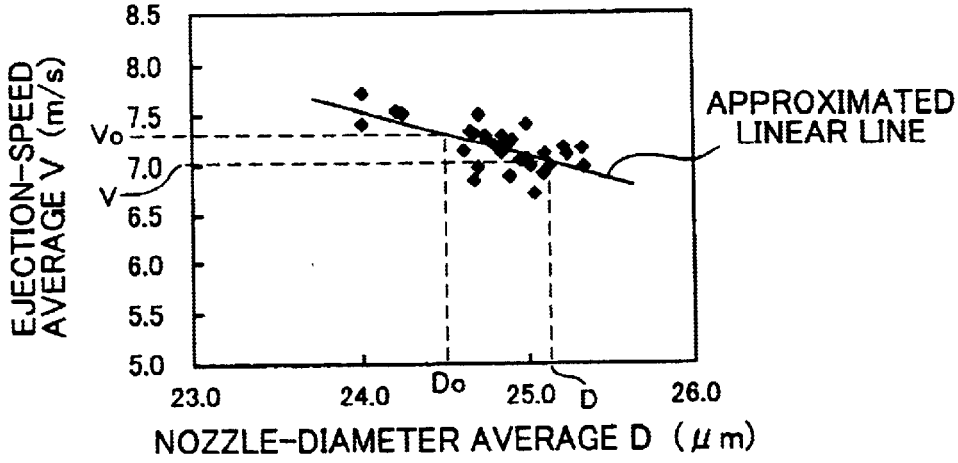
FIG. 3(A) is a graph showing the relationship between the nozzle-diameter average and the ejection-speed average.

The present inventor performed the above-described measurements for all the plurality of head unit samples 1, and plotted the measurement-result points (D, V) in the graph of FIG. 3(A). As a result, the measurement-result points (D, V) are distributed as shown in FIG. 3(A). This graph shows how the ejection-speed average V is affected by the nozzle-diameter average D.

By analyzing the graph of FIG. 3(A), the present inventor found that the distribution of the ejection-speed average V relative to the nozzle-diameter average D can be approximated by some linear or straight line.

Next will be described how to draw the line approximating the measured-result points (D, V) in the graph of FIG. 3(A) and how to determine the slope or slant of the line.

First, one straight line is set in the graph of FIG. 3(A) so that the point ($D_0$, $V_0$) is located on the line and so that the line passes through the average locations of the distributed measured-result points, wherein $D_0$ is the nozzle-diameter design value and $V_0$ is the ejection-speed design value. The thus set line ensures that when some nozzle 16 has an actual nozzle-diameter that is equal to the design value $D_0$, this nozzle 16 will eject ink with an ejection speed equal to the design ejection-speed $V_0$ upon application with the driving voltage $E_0$.

Then, the slope β of this linear line is determined by the following equation (1):

$$\beta=(V-V_0)/(D-D_0) \quad (1),$$

wherein the value (D, V) is some point, other than the point ($D_0$, $V_0$), on the linear line.

The linear line can therefore be expressed by the following formula (2):

$$V=V_0+\beta(D-D_0) \quad (2).$$

It is therefore known that if one ink-jet print head unit has nozzles 16 with their nozzle-diameter average of D being shifted from the design value $D_0$, when the ink-jet print head unit is applied with the driving voltage $E_0$, the ink-jet print head unit will eject ink with its ink-ejection speed average being substantially equal to the value V which is shifted from the design value $V_0$ as defined by the formula (2).

(Second Experiment)

The present inventor performed a second experiment in order to examine how the ink ejection speed is affected by the capacitance of the piezoelectric elements 20A.

First, the present inventor examined the relationship between the piezoelectric-element capacitance and the ejection-speed for one head unit sample 1 in a manner described below.

The present inventor measured the capacitances of all the piezoelectric elements 20A in the subject head unit sample 1, and calculated the average C of the capacitances.

It is noted that in order to measure the capacitance of each piezoelectric element 20A, the present inventor used an impedance analyzer to determine the capacitance between the electrodes 42 and 44 in the subject piezoelectric element 20A by repeatedly applying an electric voltage of a uniform time period to the piezoelectric element 20A and by measuring the value of electric currents flowing due to the electric voltage.

It is also noted that the capacitance average is calculated as a quotient obtained by dividing the sum total of the capacitances of all the piezoelectric elements 20A by the number of the piezoelectric elements 20A.

In this way, the present inventor determined the piezoelectric-element capacitance average C. Then, in order to know the relationship between the piezoelectric-element capacitance average C and the ejection-speed average V, which was already determined for the subject head unit sample 1 during the first experiment, the present inventor plotted a measured-result point (C, V), indicative of the piezoelectric-element capacitance average C and the ejection-speed average V, in the graph of FIG. 3(B), in which the horizontal axis denotes the piezoelectric-element capacitance average C and the vertical axis denotes the ejection-speed average V.

Figure 3B:
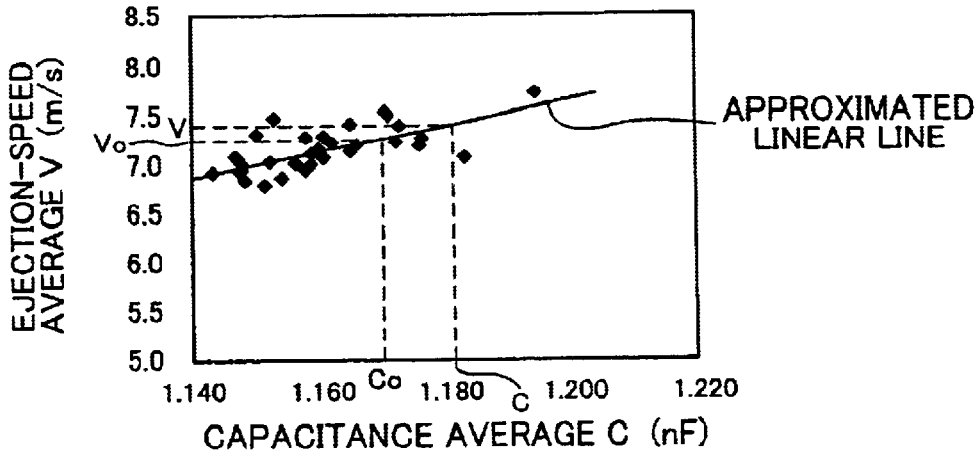
FIG. 3(B) is a graph showing the relationship between the capacitance average and the ejection-speed average.

The present inventor performed the above-described measurements for all the plurality of head unit samples 1, and plotted the measurement-result points (C, V) in the graph of FIG. 3(B). As a result, the measurement-result points (C, V) are distributed as shown in FIG. 3(B). This graph shows how the ejection-speed average V is affected by the piezoelectric-element capacitance average C.

By analyzing the graph of FIG. 3(B), the present inventor found that the distribution of the ejection-speed average V relative to the piezoelectric-element capacitance average C can be approximated by some linear or straight line.

Next will be described how to draw the linear line approximating the measured-result points in the graph of FIG. 3(B) and how to determine the slope of the linear line.

First, one linear line is set in the graph of FIG. 3(B) so that the point ($C_0$, $V_0$) is located on the linear line and so that the linear line passes through the average locations of the distributed measured-result points, wherein $C_0$ is the capacitance design value and $V_0$ is the ejection-speed design value. The thus set linear line ensures that when some piezoelectric element 20A has the actual capacitance that is equal to the design value $C_0$, the piezoelectric element 20A will eject ink with the ink-ejection speed $V_0$ upon application with the driving voltage $E_0$.

The slope α of this linear line is determined by the following equation (3):

$$\alpha=(V-V_0)/(C-C_0) \quad (3),$$

wherein the value (C, V) is some point, other than the point ($C_0$, $V_0$), on the linear line.

The linear line can therefore be expressed by the following formula (4):

$$V=V_0+\alpha(C-C_0) \quad (4).$$

It is therefore known that if one ink-jet print head unit has piezoelectric elements 20A with their capacitance average C being shifted from the design value $C_0$, when the ink-jet print head unit is applied with the driving voltage $E_0$, the ink-jet print head unit will eject ink with its ink-ejection speed average being substantially equal to the value V which is shifted from the design value $V_0$ as defined by the formula (4).

Based on the formulas (3) and (4), it is further known that if one ink-jet print head unit 1 has nozzles 16 with their nozzle-diameter average D being shifted from the design value $C_0$ and has piezoelectric elements 20A with their capacitance average C being shifted from the design value $C_0$, when the ink-jet print head unit is applied with the driving voltage $E_0$, the ink-jet print head unit will eject ink with its ink-ejection speed average V being shifted from the design value $V_0$ as defined by the following formula (5):

$$V=V_0+\alpha(C-C_0)+\beta(D-D_0) \quad (5).$$

It is therefore possible to estimate the ejection-speed average V for any ink jet print head unit 1 by measuring the nozzle-diameter average D and the capacitance average C for the ink jet print head unit 1 and by calculating the formula (5). It is unnecessary to actually drive the ink jet print head unit 1 to estimate the ejection-speed average V. The speed V calculated by the formula (5) will be referred to as "estimated ejection-speed average V" hereinafter.

(Third Experiment)

In order to confirm the accuracy of the formula (5) the present inventor again produced a plurality of head unit samples 1 in the same manner as described above so that they will have the same configuration as shown in FIGS. 1 and 2, so that they will have nozzles 16 with the nozzle diameter design value $D_0$ and piezoelectric element 20A with the capacitance design value $C_0$, and so that they will eject ink with the ejection-speed $V_0$ upon application with the driving-voltage $E_0$. However, when the head unit samples were actually produced, they had variations in their nozzle-diameters and in their piezoelectric-element capacitances, and therefore had variations in their ejection speeds.

The present inventor first examined, for one head unit sample 1, the difference between the estimated ejection-speed average V and the actual ejection-speed average V' in a manner described below.

The present inventor measured the nozzle-diameter average D and the capacitance average C for the head unit sample 1. The present inventor calculated the formula (5) by using the nozzle-diameter average D and the capacitance average C to determine the estimated ejection-speed average V for the subject head unit sample 1.

The present inventor then actually drove the head unit sample 1 with the driving voltage $E_0$, and measured the ejection speeds (actual ejection-speeds) at all the nozzles 16 in the head unit sample 1 and calculated the average V' of the actual ejection-speeds.

Figure 3C:
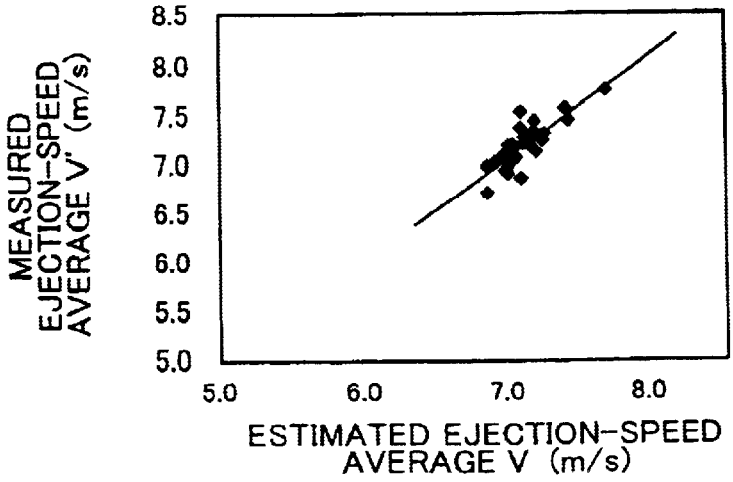
FIG. 3(C) is a graph showing the relationship between the estimated ejection-speed average and the actually-measured ejection-speed average.

The present inventor then plotted a measured-result point (V, V'), indicative of the estimated ejection-speed average V and the actual ejection-speed average V', in the graph of FIG. 3(C), wherein the horizontal axis denotes the estimated ejection-speed average V and the vertical axis denotes the actual ejection-speed average V'. The measured-result point (V, V') shows the difference between the actual ejection-speed average V' and the estimated ejection-speed average V.

The present inventor performed the above-described experiments for all the plural head unit samples. The present inventor plotted the measured-result points (V, V') in the graph of FIG. 3(C). It is confirmed from the graph of FIG. 3(C) that the value of the estimated ejection-speed average V can accurately estimate the actual ejection-speed average V'.

Next will be described the relationship between the value of the driving voltage applied to the piezoelectric elements 20A and the value of the ejection-speed average.

The ejection-speed average V proportionally changes from the design value $V_0$ when the driving voltage E changes from the design value $E_0$ as represented by the following formula (6):

$$V=V_0+\epsilon(E-E_0) \quad (6),$$

wherein $E_0$ is the driving-voltage design value, and $\epsilon$ is the sensitivity of the ejection speed relative to the driving voltage, that is, the ratio of the change of the ejection-speed relative to the change of the driving voltage. In other words, the sensitivity $\epsilon$ is the slope of a linear line (not shown) showing the relationship between the driving voltage (horizontal axis) and the ejection speed (vertical axis). It is noted that the present inventor determined the sensitivity $\epsilon$ by examining one head unit sample 1. That is, the present inventor actually drove the head unit sample 1 by applying some driving-voltage E, and measured the ejection-speeds at all the nozzles 16. The present inventor then calculated the average V of the ejection-speeds. The present inventor then plotted one measured-result point (E, V) in a graph (not shown), in which the horizontal axis denotes the driving voltage E and the vertical axis denotes the ejection-speed average V. Then, the present inventor repeatedly measured and calculated the ejection-speed average V while changing the value of the driving-voltage E. The present inventor plotted measured-result points (E, V) in the graph. Because the thus plotted measured-result points (E, V) are substantially on a linear or straight line, the present inventor calculated the slope of the line, and set the calculated slope value as the sensitivity $\epsilon$.

Based on the formulas (5) and (6), the following formula (7) can be obtained:

$$E=E_0-\{\alpha(C-C_0)+\beta(D-D_0)\}/\epsilon \quad (7).$$

By calculating the nozzle-diameter average D and the capacitance average C for any print head unit 1 and by calculating the formula (7), it is possible to estimate the value of the driving voltage E, which should be applied to the piezoelectric elements 20A in the subject print head unit 1 so that the nozzles 16 will eject ink with their ejection-speed average being equal to the design value $V_0$. It is unnecessary to actually drive the print head unit 1 to estimate the driving voltage E. The driving voltage E will be referred to as an estimated driving voltage E" hereinafter.

According to the present embodiment, when one ink jet print head unit 1, having the structure of FIGS. 1 and 2, is produced, the driving voltage to be applied to the head unit 1 is determined in a manner described below in order to adjust the ink-ejection characteristic of the head unit 1 into the optimum, desired condition.

Figure 4:
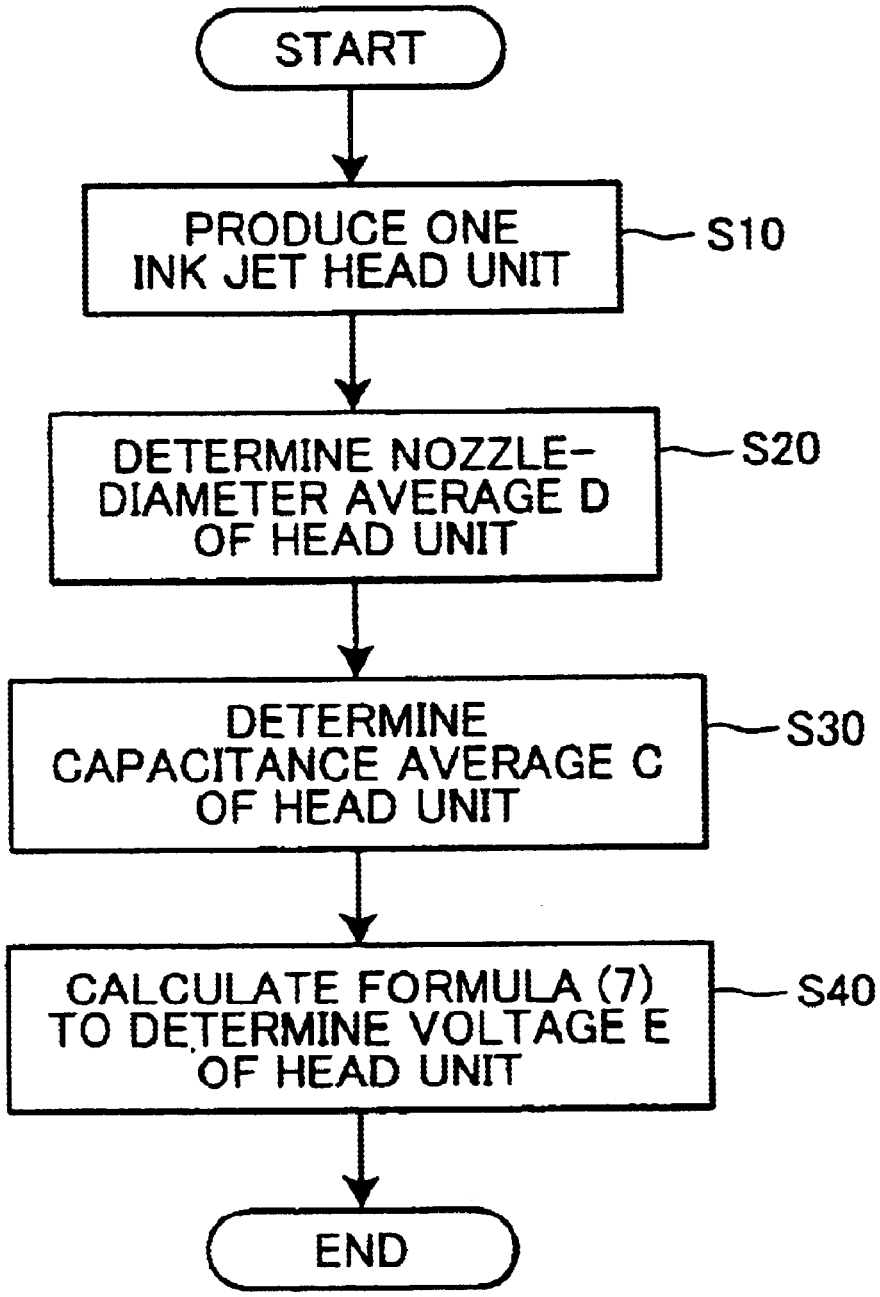
FIG. 4 is a flowchart showing the method of determining the driving voltage for a print head unit according to the embodiment.

As shown in FIG. 4, one ink jet print head unit 1 is first produced in S10, based on the design values $D_0$, $C_0$, $V_0$, and $E_0$, so that the head unit 1 will have nozzles 16 with nozzle diameters $D_0$ and piezoelectric elements 20A with capacitances $C_0$ and so that the head unit 1 will eject ink with an ejection-speed $V_0$ when applied with the driving voltage $E_0$.

After the head unit 1 is actually produced, in S20, the nozzle-diameter average D of the print head unit 1 is determined. During the process of S20, the image of each nozzle 16 is magnified, picked up, and processed, in the same manner as described already in the present inventor's performed first experiment, to thereby measure the nozzle diameters of all the nozzles 16. The nozzle-diameter average D is then calculated based on the diameters of all the nozzles 16 of the head unit 1. That is, the nozzle-diameter average D is calculated as a quotient obtained by dividing the sum total of the diameters measured of all the nozzles 16 by the number of the nozzles 16.

Next, the capacitance average C of the print head unit 1 is determined in S30. During the process of S30, the impedance analyzer is employed to measure the capacitance of all the piezoelectric elements 20, in the same manner as described already in the present inventor's performed second experiment, to thereby measure the capacitance of all the piezoelectric elements 20A. The capacitance average C is calculated based on the capacitances of all the piezoelectric elements 20A. That is, the capacitance average is calculated as a quotient obtained by dividing the sum total of the capacitances of all the piezoelectric elements 20A by the number of the piezoelectric elements 20A.

Next, the formula (7) is calculated in S40 by using the calculated values D and C to determine the estimated driving voltage E. In this way, it is possible to determine the amount of the driving voltage E, which should be applied to the subject ink jet print head unit 1 to attain the ejection-speed average to be substantially equal to the design value, that is, the desired ejection-speed $V_0$. In S40, data of the estimated driving voltage E is stored in the memory (not shown) in the driving device 30. In this way, the ejection characteristic of the ink jet print head unit 1 is adjusted to attain the desired performance.

Figure 5:
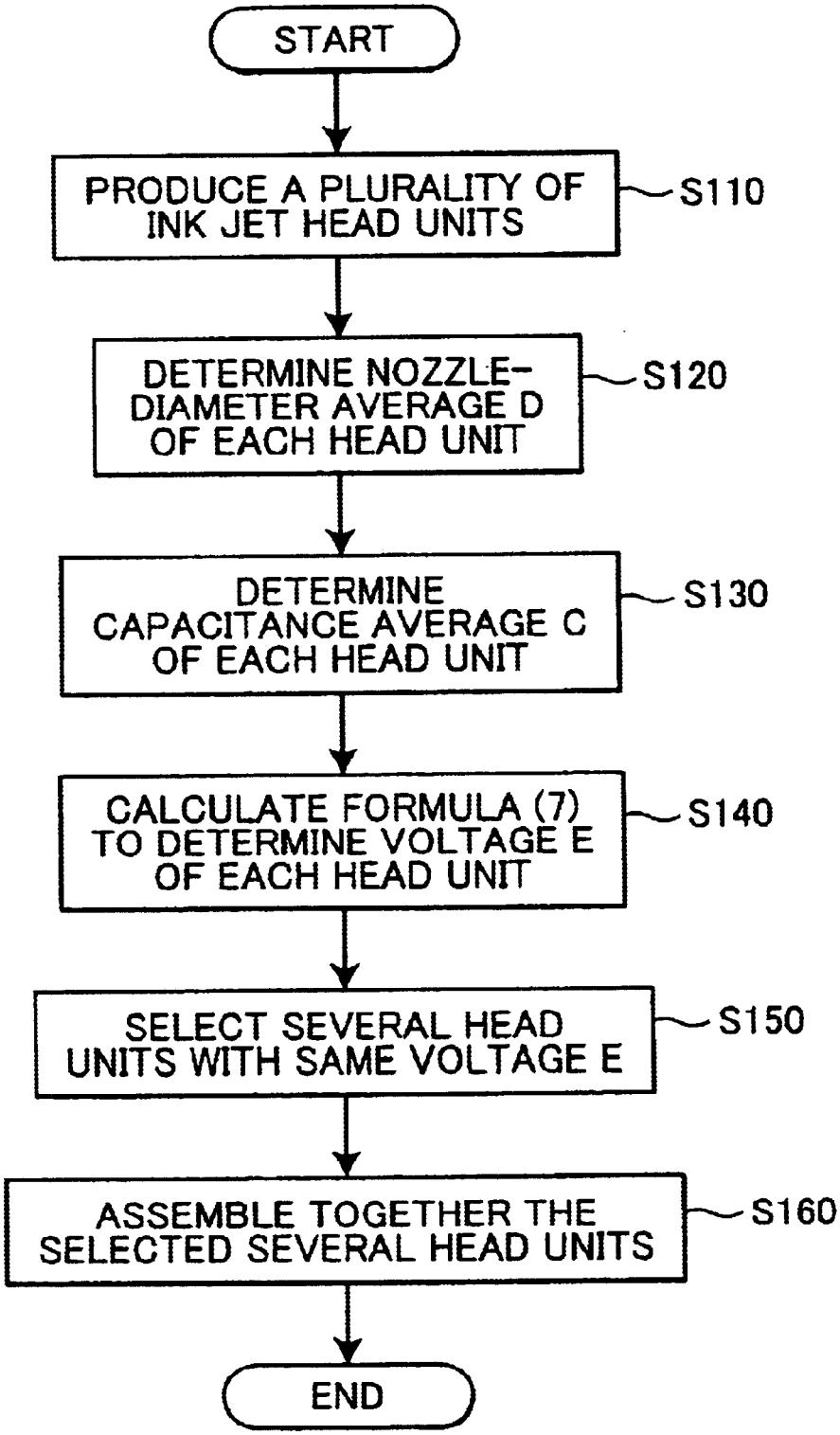
FIG. 5 is a flowchart showing the method of producing a print head by assembling together several ink-jet print head units.

When desiring to produce a print head by assembling several ink jet print head units 1 together, as shown in FIG. 5, a great number of ink jet head units 1 are first produced in S110 based on the design values $D_0$, $C_0$, $V_0$, and $E_0$ so that each head unit 1 will have nozzles 16 with nozzle diameters $D_0$ and piezoelectric elements 20A with capacitances $C_0$ and so that each head unit 1 will eject ink with an ejection-speed $V_0$ when energized by the driving voltage $E_0$.

After the great number of ink jet head units 1 are actually produced, the program proceeds to S120.

For each of all the ink jet head units 1, the nozzle-diameter average D is determined in S120, the capacitance average C is determined in S130, and the formula (7) is calculated to determine the estimated driving voltage E. It is noted that the processes of S120, S130, and S140 are the same as those of S20, S30, and S40 in FIG. 4 except that the processes of S120, S130, and s140 are executed for each of the great number of head units 1 rather than for the single head unit 1. Thus, it is possible to determine the amount of the estimated driving voltage E, which should be supplied to each of the plurality of head units 1.

Then, in S150, among the many head units 1, several head units 1, for which the estimated driving voltage E of the same values have been determined in S140, are selected. Then, in S160, the selected several head units 1 are assembled together into a single print head. In this way, it is possible to produce a single print head that can be supplied with the driving voltage of the single driving voltage E. When the ink jet print head is mounted in a printer, it is sufficient that the printer be mounted with a power supply that supplies a voltage of a single value to the ink jet print head. It is therefore possible to reduce the costs required to produce the power supply.

As described above, according to the present embodiment, when one head unit 1 is produced, the average of the diameters of the nozzles 16 is determined. Next, the average of the capacitances of the piezoelectric elements 20A is determined. Then, an optimum driving voltage V is calculated based on the predetermined formula (7) that represents the relationship between the nozzle-diameter average, the capacitance average, and the driving voltage to be applied from the driving device 30 to the piezoelectric actuator 20. When desiring to produce one print head from several head units, several head units, for which the driving voltages of the same values are estimated as optimum, are selected and assembled together into the single print head.

(Modifications)

It is noted that when the nozzles 16 are formed with a sufficiently high precision, the nozzle-diameter average D can be approximated by the design value $D_0$. In this case, in each of S20 and S120, the nozzle-diameter average D is calculated as being equal to the design value $D_0$. Accordingly, the formula (7) can be modified into the following formula (8):

$$E=E_0-\{\alpha(C-C_0)\}/\epsilon \quad (8).$$

In each of S40 and S140, the formula (8) is calculated to determine the driving voltage E.

In this case, it is unnecessary to measure the diameters of the nozzles 16. It is unnecessary to calculate the nozzle-diameter average D. In other words, the processes of S20 and S120 may be omitted from the processes of FIGS. 4 and 5. It is sufficient to determine the capacitance average C only. It is therefore possible to more easily determine the estimated driving voltage E.

Similarly, when the piezoelectric elements 20A are produced with a sufficiently high precision, the capacitance average C can be approximated by the design value $C_0$. In this case, in each of S30 and S130, the capacitance average C is calculated as being equal to the design value $C_0$. Accordingly, the formula (7) can be modified into the following formula (9):

$$E=E_0-\{\beta(D-D_0)\}/\epsilon \quad (9).$$

In each of S40 and S140, the formula (9) is calculated to determine the driving voltage E.

In this case, it is unnecessary to measure the capacitances of the piezoelectric elements 20A. It is unnecessary to calculate the capacitance average C. In other words, the processes of S30 and S130 may be omitted from the processes of FIGS. 4 and 5. It is sufficient to determine the nozzle-diameter average D only. It is therefore possible to more easily determine the estimated driving voltage E.

While the invention has been described in detail with reference to the specific embodiment thereof, it would be apparent to those skilled in the art that various changes and modifications may be made therein without departing from the spirit of the invention.

For example, in the above-described embodiment, when desiring to produce one ink jet print head for multicolor printing, several head units 1, that have the estimated driving voltage E of the same values, are selected and assembled together into a single print head. However, it may be possible to select several head units 1, that have the estimated driving-voltages E substantially equal to but slightly different from one another, and to assemble them together into a single print head.

It is noted that there will possibly be the case where it is desired to produce one ink jet print head for monochromatic printing from a plurality of head units 1. Also in this case, it is preferred to select a plurality of head units, that have the estimated driving voltage E of substantially the same values, and to assemble them together into a single print head.

In the above-described embodiment, as shown in FIGS. 4 and 5, the nozzle-diameter average D is first determined, and then the capacitance average C is determined thereafter. However, the capacitance average C may be determined first, and then the nozzle-diameter average D may be determined next.

What is claimed is:

1. A method of determining the value of a driving voltage to be applied to an ink jet print head unit, the ink jet print head unit including a cavity plate and a plurality of piezoelectric elements, the cavity plate being formed with a plurality of pressure chambers and a plurality of nozzles, each pressure chamber being filled with ink and being in fluid communication with a corresponding nozzle, the plurality of piezoelectric elements being provided in one to one correspondence with the plurality of pressure chambers, each piezoelectric element being driven by a driving voltage so as to change the pressure inside the corresponding pressure chamber, thereby allowing ink to be ejected through the corresponding nozzle from the corresponding pressure chamber, the method comprising the steps of:

determining at least one of a nozzle-diameter average and a capacitance average, the nozzle-diameter average indicating average of diameters of the plurality of nozzles, the capacitance average indicating average of capacitances of the plurality of piezoelectric elements; and determining a driving voltage to be applied to the piezoelectric elements of the ink jet print head unit by using the determined at least one of the nozzle-diameter average and the capacitance average, and based on a predetermined formula, which is indicative of a relationship of the driving voltage with respect to the at least one of the nozzle-diameter average and the capacitance average.

2. A method as claimed in claim 1, wherein the average-determining step includes at least one of the steps of:

determining the nozzle-diameter average, by measuring the diameters of all the nozzles in the ink jet print head unit, and by calculating the nozzle-diameter average based on the measured diameters; and determining the capacitance average, by measuring capacitances of all the piezoelectric elements in the ink jet print head unit, and by calculating the capacitance average based on the measured capacitances, and wherein the driving-voltage determining step calculates the predetermined formula by using the determined at least one of the nozzle-diameter average and the capacitance average, thereby determining the driving voltage.

3. A method as claimed in claim 1, further comprising the step of preparing a plurality of ink jet head units, wherein the average determining step determines at least one of the nozzle-diameter average and the capacitance average for each ink jet head unit, and the driving-voltage determining step determines the driving voltage to be applied to the piezoelectric elements in each ink jet head unit based on the at least one of the nozzle-diameter average and the capacitance average that is determined for the each ink jet head unit, further comprising the steps of:

selecting, among the plurality of ink jet head units, several ink jet head units, for which the driving-voltage determining step has determined the driving voltage of substantially the same values; and assembling together the selected several ink jet head units into a single ink jet print head.

4. A method as claimed in claim 1, wherein the average-determining step includes the steps of:

determining the nozzle-diameter average; and determining the capacitance average, wherein the predetermined formula represents a relationship among the driving voltage, the nozzle-diameter average, the capacitance average, a slope of a linear line approximately representing the relationship between the nozzle-diameter average and an ejection-speed average, which is indicative of an average of ejection speeds, at which the plurality of nozzles eject ink, and a slope of another linear line approximately representing the relationship between the capacitance average and the ejection-speed average, and wherein the driving-voltage determining step determines the driving voltage by calculating the predetermined formula based on the determined nozzle-diameter average and the determined capacitance average.

5. A method as claimed in claim 4, wherein the predetermined formula is $$E=E_0-\{\alpha(C-C_0)+\beta(D-D_0)\}/\epsilon,$$

wherein $\alpha$ is the slope of the linear line approximately representing the relationship between the capacitance average and the ejection-speed average, $\beta$ is the slope of the linear line approximately representing the relationship between the nozzle-diameter average and the ejection-speed average, D is a nozzle-diameter average variable, C is a capacitance-average variable, $D_0$ is a predetermined nozzle diameter design value, $C_0$ is a predetermined capacitance design value, $E_0$ is a predetermined driving voltage design value, $\epsilon$ is a sensitivity of the ejection speed relative to the driving voltage, and E is the driving voltage, and wherein the driving-voltage determining step determines the driving voltage E by substituting the determined nozzle-diameter average and the determined capacitance average for the nozzle-diameter average variable D and the capacitance-average variable C, respectively, in the formula.

6. A method as claimed in claim 5, wherein the capacitance average determining step sets the capacitance design value $C_0$ as the capacitance avenge C, wherein the driving voltage determining step determines the driving voltage based on the predetermined formula and based on the nozzle-diameter avenge, the predetermined formula being modified as $E=E_0-\{\beta(D-D_0)\}/\epsilon$.

7. A method as claimed in claim 5, wherein the nozzle-diameter average determining step sets the nozzle-diameter design value $D_0$ as the nozzle-diameter average D, and wherein the driving voltage determining step determines the driving voltage based on the predetermined formula and based on the capacitance avenge, the predetermined formula being modified as $E=E_0-\{\alpha(C-C_0)\}/\epsilon$.

8. A method as claimed in claim 1, wherein the average-determining step includes the step of determining the nozzle-diameter average, wherein the predetermined formula represents a relationship among the driving voltage, the nozzle-diameter average, and a slope of a linear line approximately representing the relationship between the nozzle-diameter average and an ejection-speed average, which is indicative of an average of ejection speeds, at which the plurality of nozzles eject ink.

9. A method as claimed in claim 8, wherein the predetermined formula is $$E=E_0-\{\beta(D-D_0)\}/\epsilon,$$

wherein $\beta$ is the slope of the linear line approximately representing the relationship between the nozzle-diameter average and the ejection-speed average, D is a nozzle-diameter average variable, $D_0$ is a predetermined nozzle diameter design value, $E_0$ is a predetermined driving voltage design value, $\epsilon$ is a sensitivity of the ejection speed relative to the driving voltage, and E is the driving voltage, and wherein the driving-voltage determining step determines the driving voltage E by substituting the determined nozzle-diameter average for the nozzle-diameter average variable D in the formula.

10. A method as claimed in claim 1, wherein the average-determining step includes the step of determining the capacitance average, wherein the predetermined formula represents a relationship among the driving voltage, the capacitance average, and a slope of a linear line approximately representing the relationship between the capacitance average and an ejection-speed average, which is indicative of an average of ejection speeds, at which the plurality of nozzles of the ink jet print head eject ink.

11. A method as claimed in claim 10, wherein the predetermined formula is $$E=E_0-\{\alpha(C-C_0)\}/\epsilon,$$

wherein $\alpha$ is the slope of the linear line approximately representing the relationship between the capacitance average and the ejection-speed average, C is a capacitance-average variable, $C_0$ is a predetermined capacitance design value, $E_0$ is a predetermined driving voltage design value, $\epsilon$ is a sensitivity of the ejection speed relative to the driving voltage, and E is the driving voltage, and wherein the driving-voltage determining step determines the driving voltage E by substituting the predetermined capacitance average for the capacitance-average variable C in the formula.

12. A method of adjusting an ink jet print head unit, the ink jet print head unit being connected to a driving device and including a cavity plate and a plurality of piezoelectric elements, the cavity plate being formed with a plurality of pressure chambers and a plurality of nozzles, each pressure chamber being filled with ink and being in fluid communication with a corresponding nozzle, the plurality of piezoelectric elements being provided in one to one correspondence with the plurality of pressure chambers, each piezoelectric element being driven by a driving voltage applied from the driving device so as to change the pressure inside the corresponding pressure chamber, thereby allowing ink to be ejected through the corresponding nozzle from the corresponding pressure chamber, the method comprising the steps of:

calculating a nozzle-diameter average indicating an average of diameters of the plurality of nozzles;

calculating a capacitance average indicating an average of capacitances of the plurality of piezoelectric elements; and determining a driving voltage to be applied to the piezoelectric elements based on a predetermined formula that indicates a relationship between the driving voltage and the nozzle-diameter average and the capacitance average.

13. A method as claimed in claim 12, further comprising the step of preparing a plurality of ink jet head units, wherein the nozzle-diameter average calculating step calculates the nozzle-diameter average for each ink jet head unit, the capacitance-average calculating step calculates the capacitance average for each ink jet head unit, and the driving-voltage determining step determines the driving voltage to be applied to the piezoelectric elements in each ink jet head unit based on the determined nozzle-diameter average and the determined capacitance average, further comprising the steps of:

selecting, among the plurality of ink jet head units, several ink jet head units, for which the driving-voltage determining step has determined the driving voltage of substantially the same values; and assembling together the selected several ink jet head units into a single ink jet print head.

14. A method as claimed in claim 12, wherein the predetermined formula represents a relationship between the driving voltage and both of a slope of a linear line approximately representing the relationship between the nozzle-diameter average and an ejection-speed average, which is indicative of an average of ejection speeds, with which the plurality of nozzles eject ink, and a slope of another linear line approximately representing the relationship between the capacitance average and the ejection-speed average, wherein the driving-voltage determining step determines the driving voltage based on the predetermined formula and based on the calculated nozzle-diameter average and the calculated capacitance average.

15. A method as claimed in claim 12, wherein the predetermined formula is $$E=E_0-\{\alpha(C-C_0)+\beta(D-D_0)\}/\epsilon,$$

wherein $\alpha$ is the slope of the linear line approximately representing the relationship between the capacitance average and the ejection-speed average, $\beta$ is the slope of the linear line approximately representing the relationship between the nozzle-diameter average and the ejection-speed average, D is a nozzle-diameter average variable, C is a capacitance average variable, $D_0$ is a nozzle diameter design value, $C_0$ is a capacitance design value, $E_0$ is a driving voltage design value, $\epsilon$ is a sensitivity of the ejection speed relative to the driving voltage, and E is the driving voltage.

16. A method as claimed in claim 15, wherein the capacitance-average calculating step sets the capacitance design value $C_0$ as the capacitance average variable C, and wherein the driving voltage determining step determines the driving voltage based on the predetermined formula and based on the nozzle-diameter average.

17. A method as claimed in claim 15, wherein the nozzle-diameter average calculating step sets the nozzle-diameter design value $D_0$ as the nozzle-diameter average variable D, and wherein the driving voltage determining step determines the driving voltage based on the predetermined formula and based on the capacitance average.

* * * * *